United States Patent [19]

Doerges et al.

[11] 4,144,314

[45] Mar. 13, 1979

[54] PROCESS FOR REGENERATING WATER-CONTAINING METHANOL

[75] Inventors: Alexander Doerges; Johannes Schlauer, both of Frankfurt am Main, Fed. Rep. of Germany

[73] Assignee: Metallgesellschaft Aktiengesellschaft, Frankfurt am Main, Fed. Rep. of Germany

[21] Appl. No.: 836,467

[22] Filed: Sep. 26, 1977

[30] Foreign Application Priority Data

Oct. 1, 1976 [DE] Fed. Rep. of Germany ..... 2644323

[51] Int. Cl.[2] ..... B01D 53/34

[52] U.S. Cl. ..... 423/210; 423/226; 423/235; 423/238; 55/68; 55/71; 55/73

[58] Field of Search ..... 423/210, 226, 235, 228, 423/229, 238, 232, 234; 55/68, 73, 71

[56] References Cited

U.S. PATENT DOCUMENTS

| | | | |
|---|---|---|---|
| 3,137,654 | 6/1964 | Johnson et al. | 55/73 |
| 3,972,693 | 8/1976 | Wiesner et al. | 55/73 |
| 4,011,066 | 3/1977 | Bratzler et al. | 55/73 |

*Primary Examiner*—Earl C. Thomas

*Attorney, Agent, or Firm*—Sprung, Felfe, Horn, Lynch & Kramer

[57] ABSTRACT

An improvement in a process for regenerating a water-containing, highly volatile organic solvent which has been used to scrub acid constituents from gases having a low content of water and of volatile compounds of the 8th group of the Periodic System is disclosed. According to the process, solvent which contains absorbed acid constituents is regenerated in a regeneration zone by heating the same to drive off acid constituents and de-acidified solvent is recycled in the scrubbing process. According to the invention the solvent is contacted during the regeneration with a complexing agent soluble in the solvent in an amount of 0.005 to 1 gram complexing agent per liter of solvent. A branch stream is removed from the regeneration zone which branch stream contains volatile solvent, water and metal salts dissolved in the water. The branch stream is subjected to distillation to remove overhead the volatile solvent which is returned to the regeneration zone and to leave behind an aqueous solution of the metal salt. A compensating amount of water is added to the solvent cycle.

15 Claims, 1 Drawing Figure

PROCESS FOR REGENERATING WATER-CONTAINING METHANOL

DISCUSSION OF THE PRIOR ART

It is known to use water-soluble, polar solvent, particularly methanol, for scrubbing acid constituents from gases which have been produced by a gasification of solid or liquid fuels by a treatment with steam and oxygen (German Patent Specification No. 935,144).

Particularly when gases produced by a gasification of heavy residues are scrubbed with solvents, the latter contain metal compounds which have been volatilized from the residue oil and which finally form insoluble sulfides and deposit at various points, where they give rise to trouble in operation. A simple filtration is no remedy because the metal compounds which are contained in the solvent only partially form precipitates. Colloidal solutions are formed also.

It is an object of the invention to avoid these and other disadvantages of the prior art and to prevent a formation of insoluble compounds, such as sulfides, which by a formation of deposits and crusts result in clogging and stoppages. It is also desired to facilitate the regeneration of the recirculated organic solvent by the use of the invention.

SUMMARY OF THE INVENTION

In accordance with this process there is provided an improvement in a process for scrubbing the acid constituents of a gas, especially a gas resulting from gasification of heavy residues containing metal compounds, with a solvent having a boiling point less than water and which is boiled off from an aqueous mixture wherein, subsequent to the scrubbing, the solvent is regenerated by heating the same in a regeneration zone to drive off acid constituents absorbed thereby and deacidified solvent is recycled to the scrubbing process, the improvement residing in:

A. contacting the solvent during said regeneration with a complexing agent soluble in said solvent, said complexing agent being added in an amount of 0.005 to 1 gram complexing agent per liter of solvent;

B. removing a branch stream from regenerated solvent and distilling off solvent therefrom by heating the same and returning distilled off solvent to said regeneration zone; and C. removing as the remaining phase from the distillation of step B an aqueous solution of a metal salt; and D. introducing water into said solvent cycle.

The disadvantages attendant the prior art are solved in accordance with this invention which introduces complexing agents which prevent precipitation of metal values derived from gasification of heavy residues which result in the evolution of the acid constituents absorbed by the solvent. To this end the regeneration is effected of the solvent employed in the scrubbing operation during which the acid constituents and some of the solvent are flashed or stripped off in a regeneration zone. The components leaving the regeneration zone are subjected to separation whereby the acid constituents are removed and solvent is recycled to the regeneration zone. Complexing agent is conveniently added to the returning solvent enroute to the regeneration zone. The complexing agent is suitably added in the form of an aqueous solution or of a salt thereof in an aqueous solution, as more fully discussed below. These complexing agents serve to retain the metal values in an aqueous phase thereby permitting their removal by use of a branch stream taken from the regeneration zone and subjected to distillative removal of solvent therefrom to leave behind the separated aqueous solution of metal salts. Water removed from the system in the form of an aqueous solution of salt is replaced either by water in the gas employed in the scrubbing phase or by introducing water to the solvent such as in the regeneration phase.

According to a further feature of the invention, the content of complexing agent in the solvent is controlled between 1 to 4 moles per mole of metal.

According to a further feature of the invention the addition of complexing agent is controlled only in dependence on the nickel content.

Within the scope of the invention, the complexing agents consist of ethylenediamine-tetraacetic acid, nitrolotriacetic acid or a derivative of phosphonic acid of the general formula

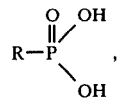

wherein R is an alkyl group containing from 1 to 12 C - atoms.

The complexing agents are preferably added in the form of dissolved ammonium compounds. The complexing agents need not be added as ammonium salts but corresponding solutions of the complexing agents and ammonia in water or organic solvents may also be added.

Ammonium compounds have the advantage of being highly soluble in water as well as in the organic solvents which are employed.

Ammonium polyphosphate alone or in combination with one or more of the other complexing agents has been found to be suitable complexing agent within the scope of the invention.

According to a further feature of the invention, the complexing agent added to the solvent cycle is contained in a dissolved complex iron compounds which contains at least 0.9 moles of iron per mole of complexing compound.

The complex iron compound may contain trivalent iron.

The advantages afforded by the invention reside particularly in that a simple process is provided by which solvents used to scrub constituents from gases can be regenerated whereby a formation of detrimental crusts and a clogging resulting in troubles in operation and stoppages are avoided.

Because an aqueous solution of complex metal compounds is withdrawn, the metal compounds which inevitably enter the solvent from the treated gas cannot become enriched in the solvent and cannot result in the above-mentioned troubles in operation.

The special feature of the invention residing in the addition of the complexing agent to the solvent cycle om a dissolved complex iron compound affords the special advantage that corrosion which could otherwise occur is avoided. This embodiment will be preferred if the compounds which are contained in the solvents and are to be rendered innocuous and removed consist mainly of nickel compounds. These specific complexing agents have a preferential tendency to form very stable compounds which nickel in such a manner that nickel can even expel iron from a previously formed complex iron compound. As a result, a dissolution of iron oxide or iron sulfide layers on the equipment walls is avoided. Such dissolution would promote a corrosion of the then bright metallic walls.

in $H_2S$ and/or HCN from the gas have also entered the solvent, it will be particularly desirable to form the above-mentioned complex iron compound by an addition of trivalent iron compounds to the complexing agent. In that case, $H_2S$ is oxidized by the trivalent iron to form elementary sulfur, which can react with HCN to form rhodanide. This rhodanide is then withdrawn in the metal salt-containing, aqueous phase stream so that the $H_2S$ and HCN contents of the solvent are reduced, the purification of gas is improved and a corrosive action of HCN is avoided.

The solvent used within the scope of the invention may consist of methanol or another water-containing, highly volatile, organic solvent, such as ethanol. Within the scope of the invention, a solvent is considered as highly volatile if it has a lower boiling point than water and when mixed with water can be distilled from the mixture, leaving water as a residue.

BRIEF DESCRIPTION OF DRAWINGS

The invention is shown diagrammatically in a flow sheet appended hereto which shows only the more significant mechanical components employed in the process. The heat exchangers, pumps, valves and the like normally employed have been omitted from the drawing for the sake of clarity.

DESCRIPTION OF SPECIFIC EMBODIMENT

Figure 1:
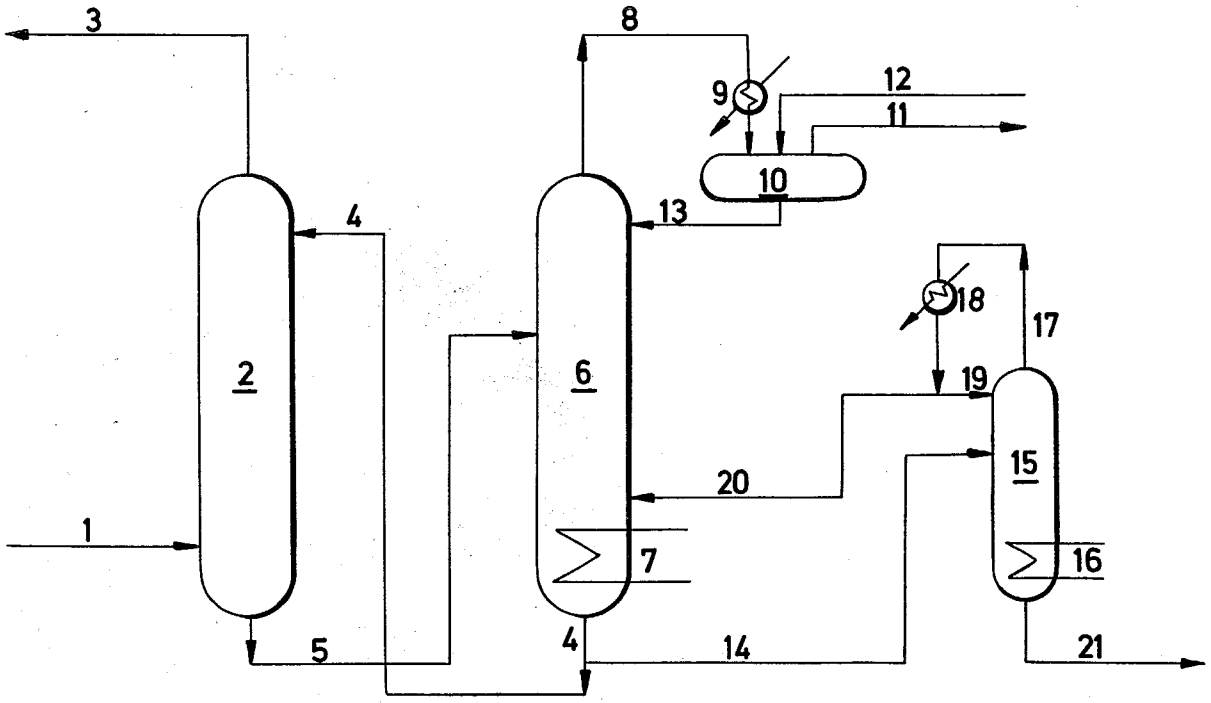

Referring to the drawings herein a gas resulting from gasification of heavy fuel oil by treatment with oxygen and steam is introduced into a scrubber 2 via conduit 1. Scrubbing solvent 4 passes in counter current flow through scrubber 2 and deacidified components are removed from scrubber 2 via line 3. Solvent containing acid components is removed from scrubber 2 via line 5 and enters regeneration zone 6.

In regeneration zone 6 the solvent is heated to drive off acid components and an overhead is taken in line 8, passed through a cooler 9 enabling acid components such as HCN to be removed in line 11. The condensed solvent, generally methanol, enters container 10 wherein it is admixed with a complexing agent added through line 12. The components are then introduced into regeneration zone 6 via line 13.

A branch line is withdrawn from line 4 while a major amount of the components in line 4 are passed to the scrubber 2. The branch line 14 feeds the solvent admixed with water and salts into distillation zone 15 which separates, distillatively, the volatile solvent which leaves through line 17, is cooled in line 18 and returned through lines 19 and 20 to distillation zone 15 and regeneration zone 6, respectively. As bottoms product there is taken a line 21 which comprises an aqueous solution of metal salts. The distillation zone 15 is heated by heater 16.

The invention can be more readily understood when reference is made to the following example:

In accordance with the drawing, a gas which has been produced by the gasification of heavy fuel oil by a treatment with oxygen and steam under superatmospheric pressure enters through conduit 1 at a rate of 150,000 standard $m^3/h$. The gas is cooled and subjected to a treatment for removing soot and then has the following composition:

| | |
|---|---|
| $H_2$ | 47.5% by volume |
| CO | 47.3% by volume |
| $CH_4 + N_2$ | 0.4% by volume |
| $CO_2$ | 4.2% by volume |
| $H_2S$ | 0.6% by volume |
| HCN | 5 $mg/m^3$ |
| $NH_3$ | 10 $mg/m^3$ |
| Ni (volatile) | 1 $mg/m^3$. |

The gas entering the scrubber 2 is under a pressure of 50 bars and is saturated with water vapor at +5° C. The gas leaving the scrubber 2 through conduit 3 is at −50° C. and a pressure of 49.5 bars and is free from water and volatile metal compounds.

The gas now has the following composition:

| | |
|---|---|
| $H_2$ | 49.3% by volume |
| CO | 47.4% by volume |
| $CO_2$ | 2.8% by volume |
| $CH_4 + N_2$ | 0.5% by volume |
| $H_2S$ | <0.1 ppm |
| Ni | none |

Cooled methanol is fed through conduit 4 to the scrubber 2 at a rate of 100 $m^3/h$. The methanol which is laden with acid constituents of the gas ($CO_2$, $H_2S$, HCN), water, $NH_3$ and volatile nickel compounds (carbonyls) leaves the scrubber through conduit 5 and is fed to a regenerating column 6.

It will be understood that the solvent may be flashed and heated before but this is not shown. It is essential, however, that the substances contained in the drain conduit 5 enter the regenerating column 6. The lower portion of the regenerating column 6 is indirectly heated by a heater 7. The rising vapors expel the volatile constituents of the gas, which are dissolved in the methanol flowing downwards in the column, and these constituents of the gas leave the regenerating column at the top through conduit 8 together with methanol vapor. Inert stripping gas may also be used for the regeneration. The methanol is condensed in a cooler 9 and then runs into a tank 10. The non-condensible gases $CO_2$, $H_2S$, HCN leave the plant through conduit 11 and are subjected to subsequent processing.

A solution of diammonium ethylene diamine tetraacetate is supplied to container 10 through conduit 12. This solution may be obtained, e.g., in that ethylenediaminetetraacetic acid is dissolved in ammoniacal water or in ammonia-containing methanol, such as becomes available in the reflux container 10. Because the 150,000 standard $m^3$ of gas entering the plant per hour contain 150 grams of nickel = 2.56 moles, the vessel 10 is fed with diammonium ethylene diamine tetraacetate $(CH_2N)_2(CH_2OONH_4)_2(CH_2COOH)_2$ at a rate of 2.56 moles = 835 g per hour, corresponding to 1 mole of complexing agent per mole of nickel. The complexing agent solution is supplied through the reflux conduit 13 to the main stream of methanol in the regenerating column 6 at a rate increasing the concentration by 0.00835 g/l of methanol. The entering nickel compounds are incorporated in complex compounds and kept in solution. Even though the recirculation results in an increase in concentration, there is no precipitation of nickel sulfide, which would be formed without an addition of a complexing agent.

A major portion of the regenerated methanol is cooled and is recycled to the scrubber 2 through conduit 4. A small branch stream which contains methanol as well as the water which is contained in the raw gas supplied through conduit 1 (22.5 kg $H_2O$ per hour), is fed through a conduit 14 to a distillation column 15, which is indirectly heated by a heater 16 so that the methanol is distilled off. The overhead vapors leaving through conduit 17 are condensed in a cooler 18 and are partly returned through conduit 19 as reflux to the top of the distillation column 15. A quantity which corresponds to the methanol supplied through conduit 14 is fed to the regenerating column 6 through conduit 20. Water at a rate of 22.5 kg/h is withdrawn through conduit 21 and contains a dissolved ammonium complex salt, which contains the nickel that has been introduced with the raw gas at a rate of 150 g/h, i.e., 6.7 g Ni/l. If water is used to form the complexing agent solution in conduit 12, more water will become available in conduit 21 and the metal concentration will be lower.

The total concentration of complexing agent and nickel in the recirculated methanol depends on the ratio of the rate of the main stress (supplied to the scrubber 2) to the rate of the branch stream (supplied to column 15 for distillation). The example which has been described results in a water concentration of 1% by weight, a nickel concentration of 0.06 g/l, and a complexing agent concentration of 0.334 g/l in the methanol, if the branch stream to be distilled is controlled at a rate of 2.5 $m^3/h$.

The same result is obtained if the ammonium ethylene diamine tetraacetate in conduit 12 is replaced by ammonium salts of nitrolotriacetic acid or of a derivative of phosphonic acid as set forth or of polyphosphoric acid added at a corresponding rate. The various complexing agents may be mixed, e.g., ethylene diamine tetraacetate and polyphosphate.

What we claim is:

1. In a process for regeneration of water-containing methanol or water-containing, highly volatile organic solvent, having a boiling point less than water, which has been used to scrub the acid constituents of a gas having a low content of water and of volatile compounds of metals of the eighth group of the Periodic System, wherein said laden solvent is regenerated by heating and/or flashing and/or stripping the same in a regeneration zone to drive off acid constituents absorbed thereby and deacidified regenerated solvent is recycled to the scrubbing process, the improvement which comprises:

A. contacting said solvent during said regeneration with a complexing agent soluble in said solvent, said complexing agent being added in an amount of 0.005 to 1 gram per liter of solvent;

B. removing a branch stream from regenerated solvent and distilling off solvent therefrom by heating the same and returning distilled off solvent to said regeneration zone;

C. removing as the remaining phase from the distillation of step B an aqueous solution of a metal salt; and D. introducing water into said solvent cycle to replace the water removed in step C.

2. A process according to claim 1 wherein said solvent is methanol.

3. A process according to claim 1 wherein water introduced in step D is received from the gas scrubbed in the scrubbing process.

4. A process according to claim 1 wherein the water introduced in step D is added to said solvent.

5. A process according to claim 1 wherein the complexing agent is present in the solvent in an amount of between 1 and 4 moles per mole of metal contained therein.

6. A process according to claim 5 wherein the amount of complexing agent is added dependent upon the amount of nickel present in the solvent.

7. A process according to claim 1 wherein the complexing agent is ethylene diamine tetraacetic acid.

8. A process according to claim 1 wherein the complexing agent is nitrolotriacetic acid.

9. A process according to claim 1 wherein the complexing agent is a derivative of phosphonic acid of the general formula

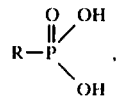

wherein R is an alkyl group containing from 1 to 12 C - atoms.

10. A process according to claim 1 wherein the complexing agent is added in the form of a dissolved ammonium compound.

11. A process according to claim 1 wherein the complexing agent is an ammonium polyphosphate and said complexing agent is employed alone or in admixture with ethylene diamine tetraacetic acid, nitrolotriacetic acid or a derivative of phosphonic acid of the general formula

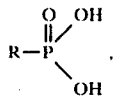

wherein R is an alkyl group containing from 1 to 12 C - atoms.

12. A process according to claim 1 wherein the complexing agent is added to the solvent in the form of a dissolved complex iron compound which contains at least 0.9 moles of iron per mole of complexing agent.

13. A process according to claim 12 wherein the added complex iron compound contains trivalent iron.

14. A process according to claim 1 wherein the water introduced in step D is added to said solvent.

15. A process according to claim 14 wherein a complexing agent is dissolved in the water introduced.

* * * * *

UNITED STATES PATENT AND TRADEMARK OFFICE

CERTIFICATE OF CORRECTION

PATENT NO. : 4,144,314

DATED : March 13, 1979

INVENTOR(S) : DOERGES et al.

It is certified that error appears in the above-identified patent and that said Letters Patent are hereby corrected as shown below:

Column 2, line 43, "compounds" should read -- compound --.

Column 2, line 51, delete "a" after "whereby".

Column 2, line 61, "om" should be -- in --.

Column 3, line 6, "in" should read -- If --.

Signed and Sealed this

*Thirty-first* Day of *July 1979*

[SEAL]

*Attest:*

*Attesting Officer*

LUTRELLE F. PARKER

*Acting Commissioner of Patents and Trademarks*